US005970743A

United States Patent [19]

Herron et al.

[11] Patent Number: 5,970,743

[45] Date of Patent: Oct. 26, 1999

[54] PRODUCTION OF ARGON FROM A CRYOGENIC AIR SEPARATION PROCESS

[75] Inventors: Donn Michael Herron, Fogelsville; Stephen John Cook, Macungie; Rakesh Agrawal, Emmaus, all of Pa.

[73] Assignee: Air Products and Chemicals, Inc., Allentown, Pa.

[21] Appl. No.: 09/096,009

[22] Filed: Jun. 10, 1998

[51] Int. Cl.[6] ..... F25J 3/04

[52] U.S. Cl. ..... 62/648; 62/924

[58] Field of Search ..... 62/924, 643, 648

[56] References Cited

U.S. PATENT DOCUMENTS

| | | | |
|---|---|---|---|
| 5,557,951 | 9/1996 | Prasad et al. | 62/648 |
| 5,590,544 | 1/1997 | Corduan et al. | 62/656 |
| 5,592,832 | 1/1997 | Herron er al. | 62/646 |
| 5,592,833 | 1/1997 | Moll | 62/648 |
| 5,692,398 | 12/1997 | Higginbotham | 62/648 |
| 5,784,899 | 7/1998 | Nojima et al. | 62/648 |
| 5,809,802 | 9/1998 | Rathbone | 62/646 |

FOREIGN PATENT DOCUMENTS

| | | | |
|---|---|---|---|
| 1963606 | 5/1998 | Germany | C01B 23/00 |
| 7146066 | of 1995 | Japan | F25J 3/04 |
| 7133982 | 5/1995 | Japan . | |

*Primary Examiner*—William Doerrler

*Attorney, Agent, or Firm*—Willard Jones II

[57] ABSTRACT

The present invention relates to a process for the cryogenic separation of air to recover at least a nitrogen-depleted crude argon product, wherein the process is carried out in a primary distillation system comprising at least a first distillation column, which separates a feed mixture comprising nitrogen, oxygen and argon into a nitrogen-enriched overhead and an oxygen-rich bottoms, and a side-arm column which rectifies an argon-containing feed stream fed from the primary distillation column to produce an essentially-oxygen-depleted argon overhead. The improvement of the present invention is characterized in that: (a) a nitrogen-containing, argon-rich side stream is withdrawn from a location of the side-arm column which is above the location of entry of the argon-containing feed stream; (b) the withdrawn, nitrogen-containing, argon-rich side stream of step (a) is fed to a nitrogen rejection column to remove the contained nitrogen, wherein the nitrogen rejection column contains at least a stripping section which is located below the location of the feed of the nitrogen-lean, argon-rich side stream, and wherein the stripping section of the nitrogen rejection column is provided with vapor boilup; (c) the nitrogen-depleted, crude argon product is recovered and removed from the bottom of the nitrogen rejection column; and (d) at least a portion of upward flowing vapor in the nitrogen rejection column is removed and the removed portion is returned to a suitable location of the side-arm column.

18 Claims, 5 Drawing Sheets

PRODUCTION OF ARGON FROM A CRYOGENIC AIR SEPARATION PROCESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a process for the production of argon from a cryogenic air separation process. In particular, the present invention relates to a process in which argon can be recovered substantially free of nitrogen.

A common method of recovering argon from air is to use a double column distillation system consisting of a higher pressure column and lower pressure column which are thermally linked with a reboiler/condenser and a side-arm rectifier column attached to the lower pressure column. The oxygen product is withdrawn from the bottom of the lower pressure column and at least one nitrogen-enriched stream is withdrawn from the top of the lower pressure column. A portion of the vapor rising through the lower pressure column is withdrawn from an intermediate location and passed to the side-arm column. This vapor portion, which generally contains between 5% and 15% argon by molar content and traces of nitrogen with the balance being oxygen, is rectified in the side-arm column to produce as an overhead, an argon-enriched stream. Typically, this argon-enriched stream, commonly, referred to as crude argon, is withdrawn from the top of the side-arm column with an oxygen content ranging from parts per millions levels to about 3% by molar content. The rectification is achieved by providing liquid reflux to the side-arm column via a condenser located at the top of the side-arm column.

Since nitrogen is more volatile than argon, most of the nitrogen contained in the side-arm column feed exits the side-arm column in the crude argon. Nitrogen is generally considered an impurity of an argon product, therefore, it is essential to limit the nitrogen content in the side-arm column feed. While the lower pressure column may be designed to virtually eliminate nitrogen from the side-arm column feed, in actual operation, some nitrogen is generally present. For example, plant upsets and flow ramping often cause the composition profile in the lower pressure column to shift from the design point to one in which nitrogen is present in the vapor portion fed to the side-arm column. Additionally, the reboiler/condenser located at the bottom of the lower pressure column could have small leaks which allow nitrogen from the higher pressure side to enter the column in a region which, by design, should be essentially nitrogen-free.

Since complete elimination of nitrogen from the side-arm column feed is difficult to achieve, it is widely accepted that nitrogen will be present in the crude argon withdrawn from the top of the side-arm column. As a consequence, the crude argon withdrawn from the side-arm column is typically subjected to an additional separation step by feeding it to a distillation column containing both rectifying and stripping sections, a reboiler located at its bottom and a condenser located at its top. Numerous patents exist in the art which describes such a column. See, for example, U.S. Pat. No. 5,590,544.

Many have reported that the nitrogen content of the crude argon withdrawn from he side-arm column may be reduced by withdrawing the crude argon from an intermediate location of the side-arm column.

Japanese Patent No. 07133982 discloses that the nitrogen content of the crude argon can be reduced by withdrawing said crude argon from an intermediate location of the side-arm column and removing nitrogen in a second, vapor purge stream taken from the top of the side-arm column. In Japanese Patent No. 07146066, an additional separation column is added to further treat the withdrawn crude argon, presumably, in recognition that not all the nitrogen may be reliably eliminated from the argon simply by withdrawing the stream from an intermediate location of the side-arm column.

U.S. Pat. No. 5,557,951 and DE-19636306-A2 disclose the practice of withdrawing the crude argon from the side-arm column at an intermediate location. In both these disclosures, there are no additional separation steps applied to the crude argon for the purpose of further removing nitrogen. Therefore, successful application of these disclosures requires that the nitrogen content of the side-arm column feed be kept below a threshold value.

As the off-design operation of the lower pressure column may cause the nitrogen content of the side-arm column feed to increase above the design level, the off-design operation of the side-arm column may also cause the nitrogen content of the crude argon to increase even though a vapor purge stream is employed. For example, it is critical that the nitrogen be allowed to exit the top of the side-arm column in the vapor purge stream. In practice, this stream can contain significant quantities of argon as well. Hence it is desirable to minimize the flow of the vapor purge stream to reduce argon losses. Unfortunately, restricting the flow of this vapor purge stream causes nitrogen to accumulate in the side-arm column, potentially causing nitrogen to appear in the crude argon.

The present invention allows for the production of substantially nitrogen-free argon in a cost effective and operationally sound manner.

BRIEF SUMMARY OF THE INVENTION

The present invention relates to a process for the cryogenic separation of air to recover at least a nitrogen-depleted crude argon product, wherein the process is carried out in a primary distillation system comprising at least a first distillation column, which separates a feed mixture comprising nitrogen, oxygen and argon into a nitrogen-enriched overhead and an oxygen-rich bottoms, and a side-arm column which rectifies an argon-containing feed stream fed from the primary distillation column to produce an essentially-oxygen-depleted argon overhead. The improvement of the present invention is characterized in that:

(a) a nitrogen-containing, argon-rich side stream is withdrawn from a location of the side-arm column which is above the location of entry of the argon-containing feed stream;

(b) the withdrawn, nitrogen-containing, argon-rich side stream of step (a) is fed to a nitrogen rejection column to remove the contained nitrogen, wherein the nitrogen rejection column contains at least a stripping section which is located below the location of the feed of the nitrogen-lean, argon-rich side stream, and wherein the stripping section of the nitrogen rejection column is provided with vapor boilup;

(c) the nitrogen-depleted, crude argon product is recovered and removed from the bottom of the nitrogen rejection column; and (d) at least a portion of upward flowing vapor in the nitrogen rejection column is removed from a location which is coincident to or above the location of the feed of the nitrogen-lean, argon-rich side stream to the nitrogen rejection column and the removed portion is returned to a suitable location of the side-arm column.

In the preferred embodiment of the process of the present invention, the withdrawn, nitrogen-containing, argon-rich side stream of step (a) is a liquid, which can be removed from a location of the side-arm column above the feed point to the column, preferably, from between 1 and 10 stages below the top of the side-arm column.

In an embodiment of the process of the present invention, the side-arm column can also include a reboiler/condenser located at the top, wherein the oxygen-depleted argon overhead is removed from the side-arm column and partially condensed in the reboiler/condenser.

There are several embodiments of the process of the present invention with respect to the use of the partially condensed oxygen-depleted argon overhead. Among these are: (1) the partially condensed, oxygen-depleted argon can be separated into a liquid phase portion and a vapor phase portion, wherein the vapor phase portion is vented as a nitrogen-containing purge; (2) the partially condensed, oxygen-depleted argon can be separated into a liquid phase portion and a vapor phase portion, wherein the vapor phase portion is partially condensed and phase separated into a second vapor phase portion and a second liquid phase portion and wherein the second vapor phase portion is vented as a nitrogen-containing purge; (3) the partially condensed, oxygen-depleted argon can be fed to a first auxiliary column for rectification into a first auxiliary column overhead and a first auxiliary column bottoms liquid, wherein the first auxiliary column overhead is partially condensed and phase separated into a second vapor phase portion and a second liquid phase portion and wherein the second vapor phase portion is vented as a nitrogen-containing purge; (4) the partially condensed, oxygen-depleted argon can be separated into a liquid phase portion and a vapor phase portion, wherein the vapor phase portion is fed to a rectifying dephlegmator producing a dephlegmator overhead and wherein the dephlegmator overhead is vented as a nitrogen-containing purge; and (5) the partially condensed, oxygen-depleted argon can be separated into a liquid phase portion and a vapor phase portion, wherein the vapor phase portion is fed to a first auxiliary column for rectification into a first auxiliary column overhead and a first auxiliary column bottoms liquid and wherein the first auxiliary column overhead is vented as a nitrogen-containing purge.

In the process of the present invention, the nitrogen rejection column can also comprise a rectification section which is located above the location of the feed of the nitrogen-lean, argon-rich side stream; wherein vapor overhead exiting the top of the rectification section is removed from the nitrogen-rejection column and partially condensed, wherein the partially condensed overhead from the rectification section of the nitrogen rejection column is separated into a liquid phase portion and a vapor phase portion and wherein the vapor phase portion is vented as a nitrogen-containing purge.

When the partially condensed, oxygen-depleted argon is separated into a liquid phase portion and a vapor phase portion, the process of the present invention, can further comprise returning the liquid phase portion to the side-arm column as reflux.

The process of the present invention is particularly suited to a distillation system which comprises a double distillation column consisting of a higher pressure column and a lower pressure column, and wherein the lower pressure column is the primary distillation column.

In the process of the present invention, vapor boil up for step (b) is provided by heat exchange between a suitable stream which is subcooled and the nitrogen rejection column liquid bottoms.

In the process of the present invention, the withdrawn, nitrogen-containing, argon-rich side stream of step (a), would typically have a low oxygen content, i.e., parts per million quantities. Nevertheless, the process of the present invention would still work if the withdrawn, nitrogen-containing, argon-rich side stream of step (a) has a higher oxygen content, e.g., 3% by molar content. In such cases, it is understood that additional processing steps may be required for further purification of either the withdrawn, nitrogen-containing, argon-rich side stream of step (a) or the nitrogen-depleted, crude argon product.

DETAILED DESCRIPTION OF THE INVENTION

Having described the process of the present invention in summary above, the invention will now be described in detail with reference to the several embodiments shown in FIGS. 1 through 5.

In the discussion of the present invention, the term "nitrogen-depleted" includes the concept of being "nitrogen-free". Further, the term "oxygen-depleted" includes "oxygen-lean".

Figure 1:
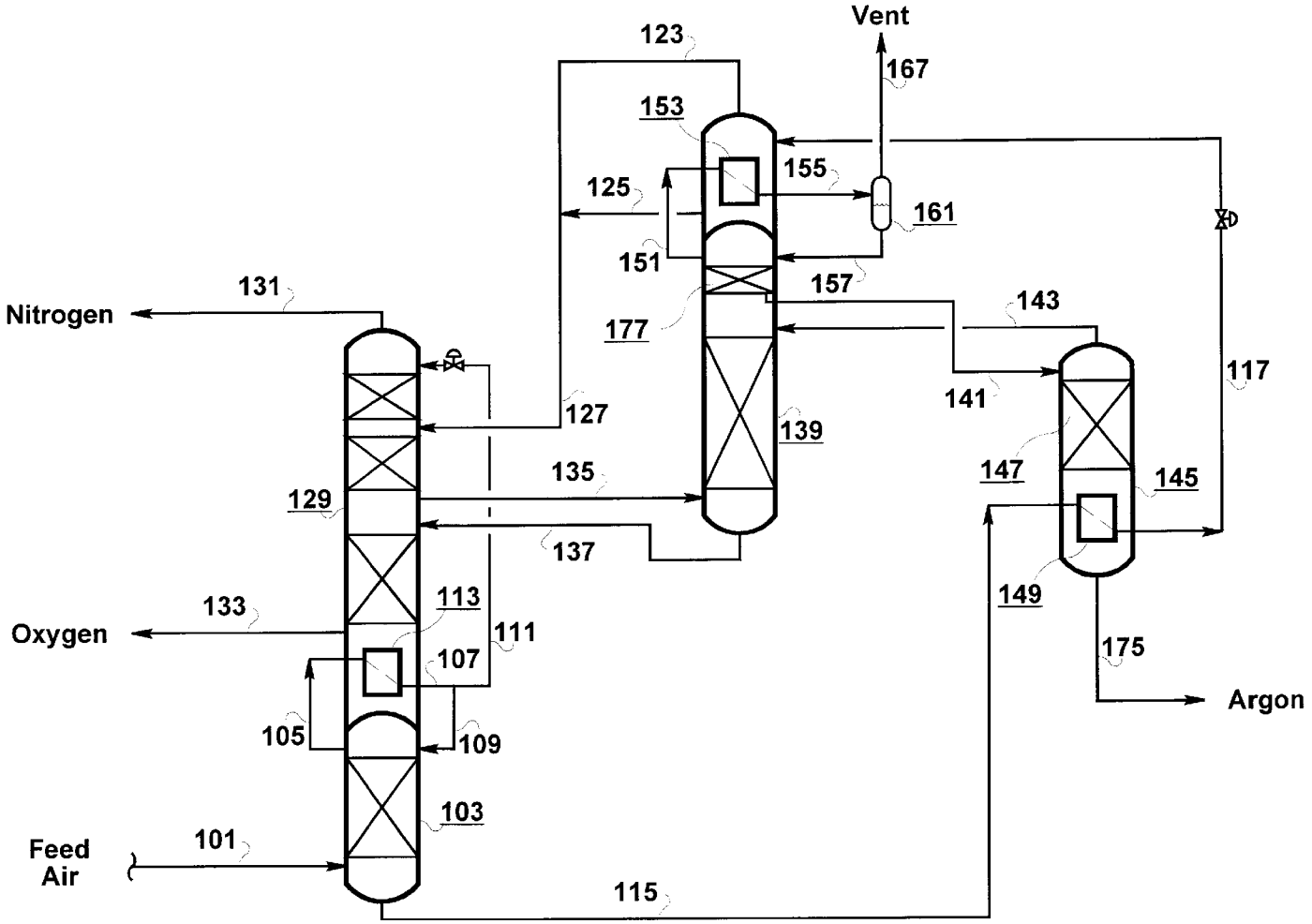
FIGS. 1 through 5 are schematic diagrams of several embodiments of the process of the present invention.

In FIG. 1, the compressed feed air stream free of heavy components such as water and carbon dioxide, and cooled to a suitable temperature is introduced as stream 101 to the bottom of higher pressure column 103. The pressure of this feed air stream is generally greater than 3.5 atmospheres and less than 24 atmospheres, preferably in range of 5 to 10 atmospheres. The feed to the higher pressure column is distilled into higher pressure nitrogen vapor stream 105 at the top and crude liquid oxygen stream 115 at the bottom.

Nitrogen vapor stream 105 is condensed in reboiler/condenser 113 to produce liquid stream 107 which is subsequently split into two streams, 109 and 111. Stream 109 is returned to the higher pressure column as reflux. Stream 111 is directed to the top of lower pressure column 129 as reflux. Though not shown for simplicity, lower pressure column reflux stream 111 is often cooled via indirect heat exchange with another stream prior to introduction to lower pressure column 129.

Crude liquid oxygen stream 115 is subjected to any number of optional indirect heat exchanges and eventually introduced to the lower pressure column as stream 127. The feeds to the lower pressure column are distilled into lower pressure nitrogen vapor stream 131 at the top and oxygen stream 133 at the bottom.

An argon-containing vapor stream is withdrawn from an intermediate location of the lower pressure column as stream 135. This argon-containing stream, which may contain between 3% to 25% argon but typically contains between 5% to 15% argon, is passed to side-arm column 139 as a bottom feed. The argon-containing feed to the side-arm column is distilled to reduce the oxygen concentration in the ascending vapor and produces top vapor stream 151 and bottom liquid stream 137.

The bottom liquid stream 137 is returned to the lower pressure column.

According to step (a) of the invention, stream 141 is withdrawn (in this example, as a liquid) from side-arm column 139 from a location above the argon-containing feed (here shown as an intermediate location). According to step (b) of the invention, stream 141 is passed to nitrogen rejection column 145 which contains stripping section 147.

Reboiler 149 produces the upward vapor flow for stripping section 147. Reboil for the nitrogen rejection column can be provided by any number of means and for illustration here is provided by cooling crude liquid oxygen stream 115 in reboiler 149 to form stream 117.

Feed 141 is distilled in the nitrogen rejection column to produce nitrogen-depleted, crude argon stream 175 in accordance with step (c) of the invention. Though the invention strives only to reduce the concentration of nitrogen in argon stream 175 relative to the concentration of nitrogen in feed stream 141, in the preferred mode the concentration of nitrogen in stream 175 is reduced to less than 50 ppm and most preferably to less than 10 ppm.

According to step (d) of the invention, upward flowing vapor is removed from the nitrogen rejection column as stream 143 and returned to side-arm column 139.

The top vapor 151 from the side-arm column is partially condensed in reboiler/condenser 153 to form two-phase stream 155 which is then passed to separator 161 to collect liquid reflux for the side-arm column as stream 157 and produce vapor purge stream 167. Refrigeration for side-arm column reboiler/condenser 153 can be provided by any number of suitable means, but, as shown in FIG. 1, is commonly provided by partially vaporizing crude liquid oxygen, in this case stream 117. If stream 117 is partially vaporized, it is typically removed from reboiler/condenser 153 as a separate vapor stream (123) and liquid stream (125) and then combined (to form stream 127).

It is not necessary that all of crude liquid oxygen stream 117 be sent to reboiler/condenser 153. In many cases, it is desirable to split stream 117, send only a portion of the flow to reboiler/condenser 153 and send the rest directly to the lower pressure column as an additional feed, preferably to a location above where the partially vaporized stream enters.

The embodiment of the invention described in FIG. 1 has the advantage over the background processes in that more nitrogen can be tolerated in the argon-containing side-arm column feed stream 135. The advantage manifests itself in at least two major ways.

First, since more nitrogen may be tolerated in the side-arm column feed, it is not necessary to provide as much vapor flow in the lower pressure column in the region above the side-arm column off-take. As a result, more vapor flow is available for the side-arm column and argon recovery may be increased. Alternatively and/or additionally, fewer stages are required in the lower pressure column above the off-take for argon-containing stream 135.

A second advantage is related to off-design operation. This invention allows the introduction of excess nitrogen into the side-arm column during a ramping or upset condition. This capability exists because even though more nitrogen may appear in feed stream 141 to the nitrogen rejection column, the existence of stripping section 147 and reboiler 149 enables nitrogen to be rejected from the crude argon stream 175.

Figure 2:
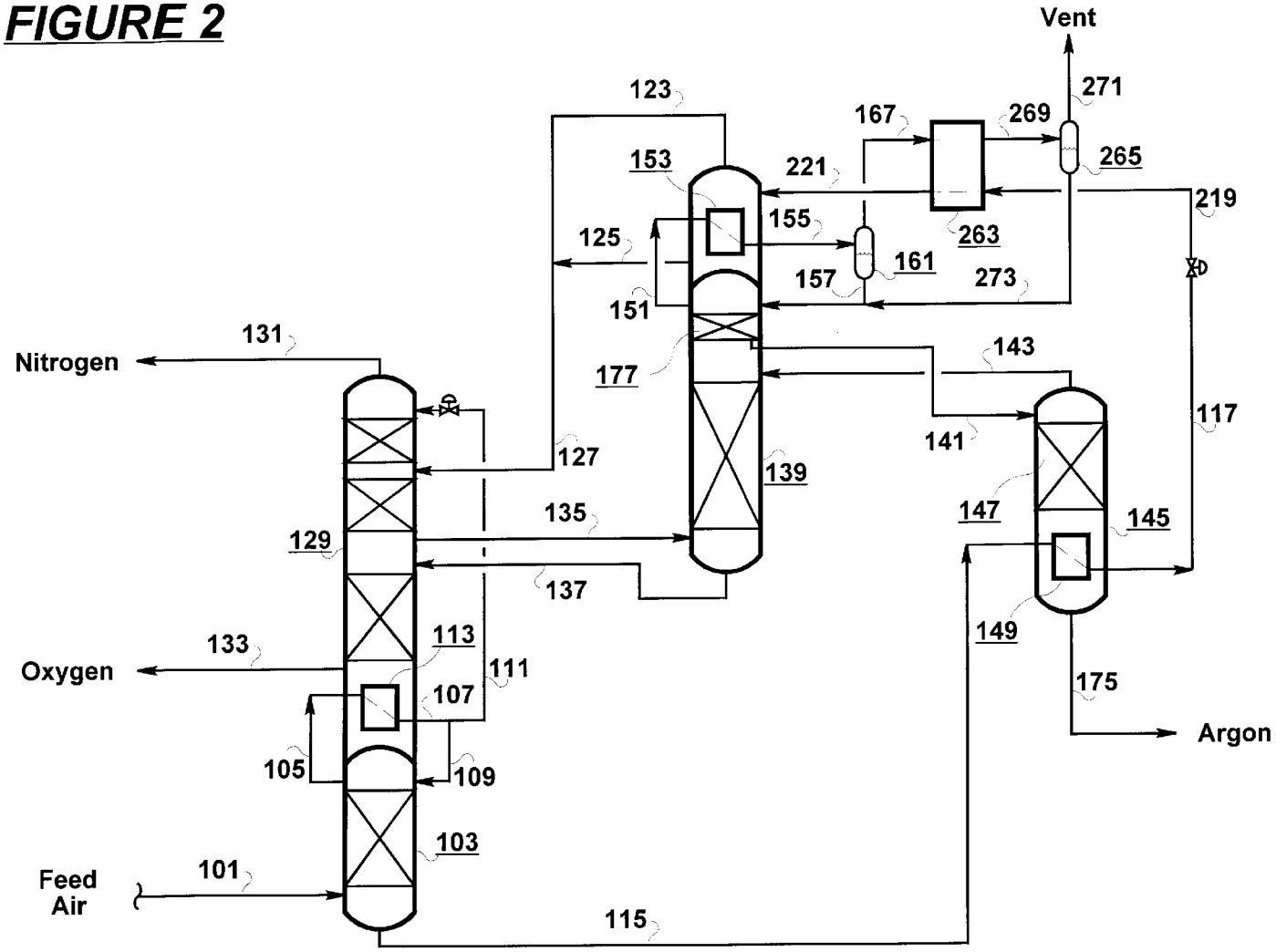

FIG. 2 shows another embodiment of the invention. In FIG. 2, the original nitrogen-containing vapor purge stream 167 is partially condensed in heat exchanger 263 to form two-phase stream 269 which is then passed to separator 265 to collect additional liquid reflux for the side-arm column as stream 273 and produce the final vapor purge stream 271. Stream 271 is further enriched in nitrogen and contains the bulk of the nitrogen which enters the side-arm column in stream 135.

The embodiment as described in FIG. 2 may be used for benefit in one of at least three ways.

First, by further condensing stream 167 the argon content in vapor purge stream 271, and flow of vapor purge stream 271, can be further lowered (relative to the embodiment of FIG. 1) to reduce argon losses.

Alternatively, if the vapor purge flow remains the same, but the nitrogen content of the vapor purge increases, it is possible to allow more nitrogen to enter the side-arm column in argon-containing stream 135.

Finally, for the same vapor purge composition in stream 271 as in stream 167 of FIG. 1, the argon content of stream 167 in FIG. 2 may be increased to allow reboiler/condenser 153 to operate at a warmer temperature level.

The flow of reflux return stream 273 is relatively small, as a result, stream 273 may alternatively be returned to the lower pressure column instead of to the side-arm column. This might be accomplished in a number of different ways, for example: 1) gravity drain or pump stream 273 directly to the lower pressure column, 2) gravity drain or pump stream 273 into reboiler/condenser 153 and mix with the crude liquid oxygen therein.

Figure 3:
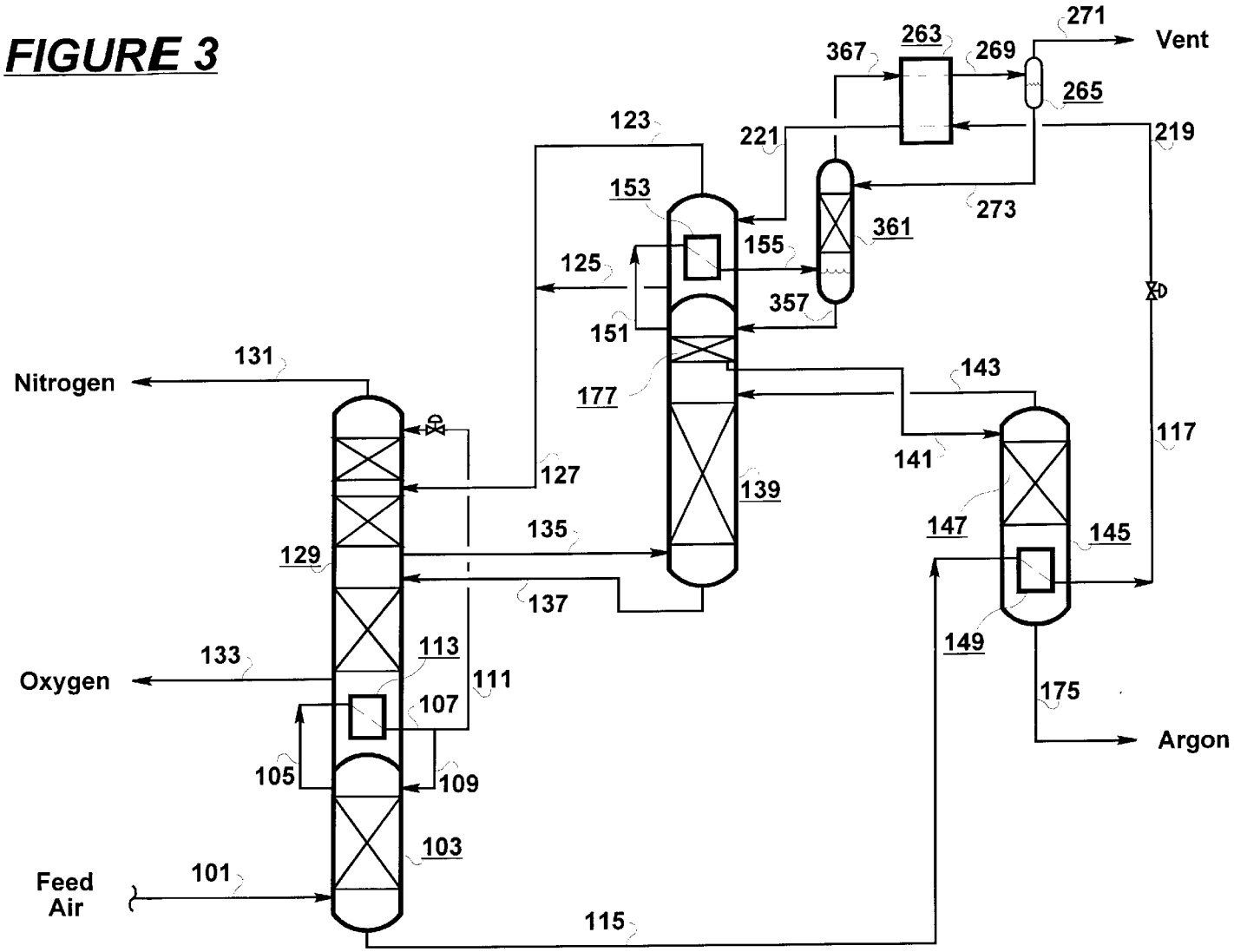

FIG. 3 shows another embodiment of the invention and represents an alternative to FIG. 2. In FIG. 3, separator 161 has been replaced with column 361 and the liquid from separator 265 is returned to column 361 as additional reflux stream 273. This embodiment may be employed to eliminate rectifying section 177 in the side-arm column. As in the embodiment shown in FIG. 2, this embodiment allows the nitrogen content of vapor purge stream 271 to be greatly increased or, alternatively, allows the nitrogen content of stream 155 leaving the side-arm column to be greatly reduced.

It is possible to replace column 361 and exchanger 263 with a single device which simultaneously carries out the heat exchange and mass exchange. Such a device is called a reflux-condenser, or dephlegmator (see for example U.S. Pat. No. 5,592,832, 1997).

Figure 4:
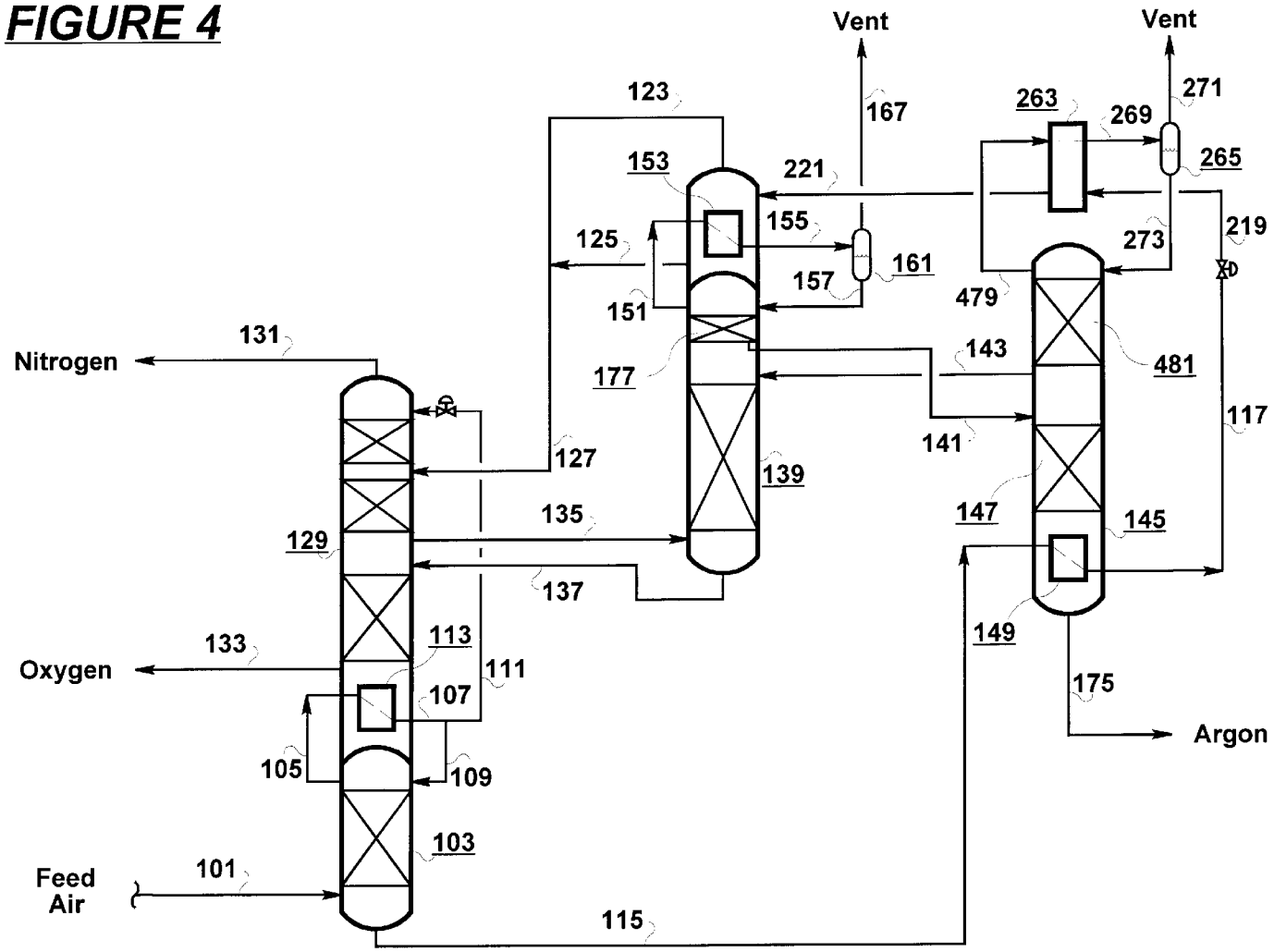

FIG. 4 shows another embodiment of the invention. The major change compared to FIG. 2 is that an additional rectifying section 481, has been added to the nitrogen rejection column. Of the vapor coming from stripping section 147 below feed 141 only a portion is returned to the side-arm column as stream 143. The remainder travels up through section 481 and leaves the nitrogen rejection column as stream 479. Stream 479 is partially condensed in exchanger 263 to form two-phase stream 269 which is then passed to separator 265 to collect liquid reflux for the nitrogen rejection column as stream 273 and produce vapor purge as stream 271. The top vapor 151 from the side-arm column is partially condensed in reboiler/condenser 153 to form two-phase stream 155 which is then passed to separator 161 to collect liquid reflux for the side-arm column as stream 157 and produce vapor purge stream 167.

As shown in FIG. 4, nitrogen is purged from the argon recovery system in two streams: 167 and 271. This configuration is useful for processes that are subject to major upsets in the nitrogen content of the argon-containing side-arm column feed 135. Under normal operating conditions, most of the nitrogen is purged as stream 167 and the mode of operation is much like that depicted in FIG. 1. Under upset conditions, excess nitrogen may be purged from the top of the nitrogen rejection column to allow the operation of the side-arm column reboiler/condenser 153 to be less disrupted. This is important since the major heat exchange duty is in reboiler/condenser 153.

Potentially, useful variations to FIG. 4 include: 1) elimination of the rectifying section 177 in the side-arm column, and 2) passing feed 141 to the nitrogen rejection column as a vapor.

Figure 5:
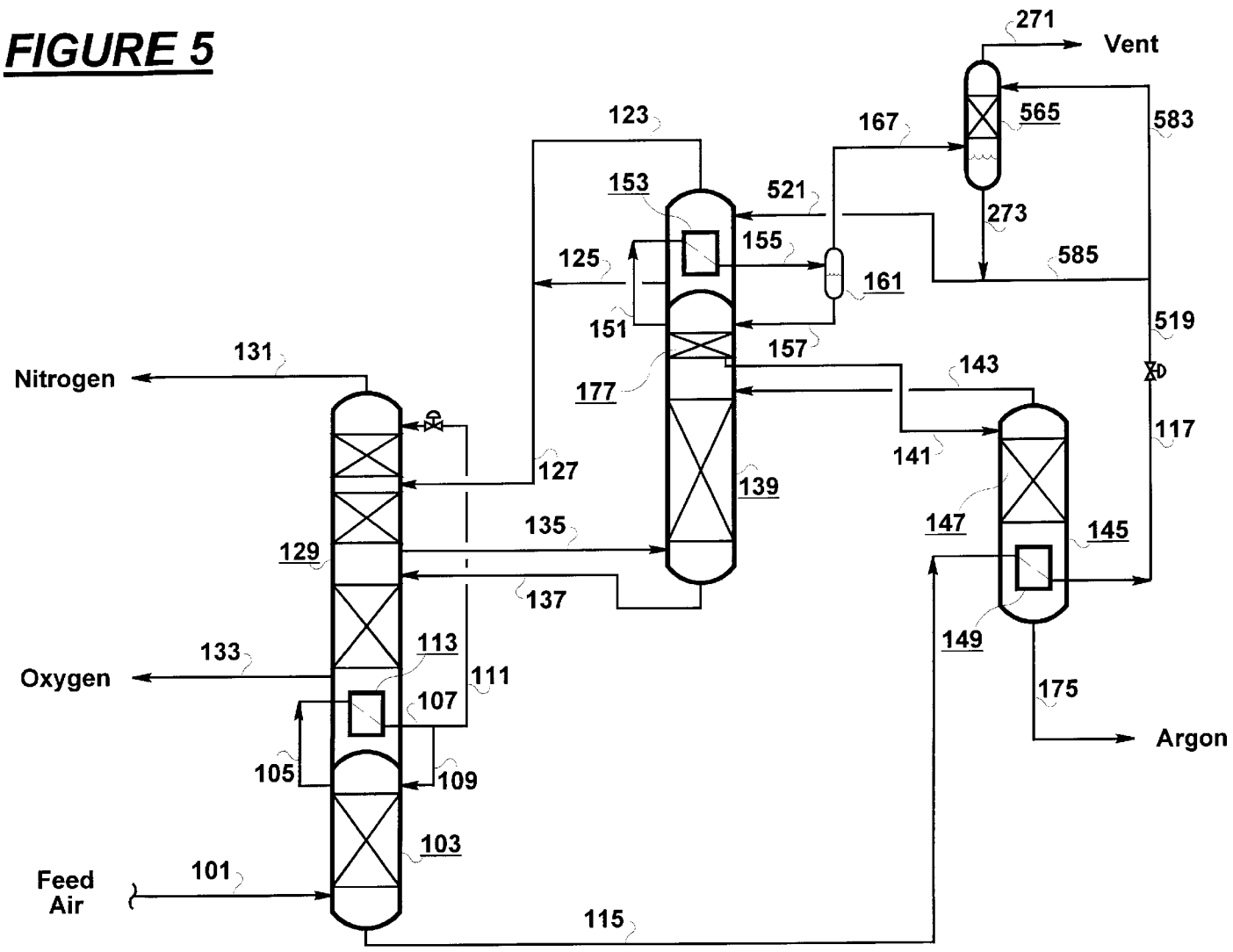

FIG. 5 illustrates another embodiment of the invention. In this mode of operation, separator 265 is eliminated in favor of supplemental column 565. Vapor stream 167 is passed to the bottom of column 565 as one of two feeds; liquid stream 583 is passed to the top of column 565 as the other feed. Stream 583 contains a relatively low concentration of argon (typically around 1%) and therefore makes an excellent reflux for reducing the argon losses in vapor purge stream 271.

It is generally advantageous to pass the bottoms stream 273 to the lower pressure column as this stream is likely to contain valuable oxygen in addition to argon. In this example, it is convenient to combine stream 273 with the remainder of crude liquid oxygen stream 585 as a means to pass stream 273 (eventually) to the lower pressure column.

In FIG. 5, reflux for column 565 was derived from the crude liquid oxygen stream 117. It will be known to a practitioner of the art that any liquid stream with low argon content would be a suitable substitute for crude liquid oxygen; some examples include a condensed air stream or a liquid nitrogen stream.

In FIGS. 1–5, the oxygen product stream 133 is depicted as being withdrawn from the lower pressure column as a vapor. This invention is not limited to such an operation. It will be known to a practitioner of the art that oxygen stream 133 may be withdrawn from the lower pressure column as a liquid, pumped to delivery pressure, then vaporized and warmed before being passed to the customer. This technique is referred to as pumped-liquid oxygen. To facilitate the vaporization of the pumped oxygen stream it is common to compress a portion of feed air, then cool and condense that portion of feed air. Typically, this condensed high pressure air is used as a feed to the higher pressure column, the lower pressure column, or both. Condensed air may be used in this invention in an analogous manner as crude liquid oxygen is used. For example: 1) condensed air may be cooled to provide the heat input for reboiler 149 of the nitrogen rejection column, 2) condensed air may be used as reflux stream 583 in FIG. 5, 3) after being cooled and/or suitably reduced in pressure, condensed air may be used to provide refrigeration for exchanger 263 in FIGS. 2–4, and 4) condensed air may used in reboiler/condenser 153 to supplement the crude liquid oxygen.

As with condensed air, any liquid stream may alternatively be withdrawn from the higher pressure column and utilized for reboiler 149, exchanger 263, and/or reboiler/condenser 153.

In FIGS. 1–5, heat input to reboiler 149 is provided by cooling crude liquid oxygen. As stated above, other suitably warm fluids may be cooled. In addition, a fluid may be condensed in reboiler 149 to provide heat input; examples include a portion of vapor nitrogen (such as from stream 105) and a portion of vapor air (such as from stream 101).

In FIGS. 1–5, no reference is made to the nature of the mass exchange sections (i.e., stripping sections or rectifying sections) in any of the distillation columns. It will be known to a practitioner of the art that any of sieve trays, bubble-cap trays, valve trays, random packing, or structured packing, used individually or in combination, are suitable for the application of this invention.

In FIGS. 1–5, the vapor purge stream leaving the argon recovery system may or may not be a desired product and when not desired represents lost crude argon. It is possible to recover at least a portion of the contained argon by recycling the vapor purge stream to the lower pressure column. If the pressure of the vapor purge stream is less than the pressure of the lower pressure column, the vapor may either be compressed by mechanical means or educted into either the crude liquid oxygen or condensed-air streams as they are reduced in pressure (for example).

Cooling for heat exchanger 263 is shown in FIGS. 2–4 as being supplied by warming or partially vaporizing crude liquid oxygen stream 219. In general, this cooling duty may be provided by warming or vaporizing any suitable process stream. One alternative is for all (or a portion) of nitrogen reflux stream 111 to be used. In this event the nitrogen stream 111 could either be warmed, in which case it would have previously been cooled by heat exchange with some other sufficiently cold process stream, or could be at least partially vaporized, in which case stream 111 would have been previously reduced in pressure. Another alternative arises when pumped-liquid oxygen is employed as a processing option. In this event the condensed liquid air stream may be either warmed or vaporized just as previously described for nitrogen stream 111. The selection of the most preferred stream is an optimization exercise. The colder the fluid used, the higher the nitrogen content of the vapor purge stream and the lower the argon losses—thus, use of the nitrogen reflux 111 appears the best choice. On the other hand, this colder fluid also represents the best feed stream for reducing oxygen losses from the lower pressure column. Hence a trade-off exists between increasing oxygen recovery and increasing argon recovery.

For all the embodiments described, an acceptable modification is the removal of the rectifying section 177 in the side-arm column.

The embodiments of FIGS. 1–5 illustrate the application of the invention to a double column process. It will be understood by a practitioner of the art that the double column processes shown in FIGS. 1–5 are simplified for clarity. Other feeds to the double column system often exist, for example: 1) a portion of the feed air stream may be expanded for refrigeration and fed to lower pressure column 129, 2) multiple oxygen products may be withdrawn from column 129, 3) an additional nitrogen-enriched stream may be withdrawn from a location above feed 127 in column 129. Although double column configurations are the most common for recovery of oxygen and argon from air, the invention is not limited to such configurations. For example, there exist single column processes for oxygen recovery from air. Such processes may easily add a side-arm column and in such an event, the invention described herein would be applicable.

For the purposes of producing steady state operation of the invention, it is useful to apply some degree of flow control to such streams as: argon-containing vapor stream 135; feed stream 141 to the nitrogen rejection column; nitrogen-depleted crude argon stream 175 and the nitrogen-containing purge streams. Flow control would be carried out by direct flow measurement or by some inferred variable. Flow is varied to maintain constancy of strategic compositions which might be product compositions or compositions internal to the distillation column system. In any control method, it can be understood that a temperature measurement can be used in place of a direct composition measurement.

Finally, in FIGS. 1–5 argon-containing stream 135 is shown to be transferred as a vapor from the lower pressure column to the side-arm column. Optionally, the process of the current invention is equally applicable when stream 135 is in the liquid state. In this event, a stripping section is often added to the side-arm column below the location at which the argon-containing feed is introduced and some means of supplying vapor flow to this new section is required (often with the use of a reboiler located at the base of the side-arm column).

Although illustrated and described herein with reference to certain specific embodiments, the present invention is nevertheless not intended to be limited to the details shown. Rather, various modifications may be made to the details within the scope and range of equivalents of the claims and without departing from the spirit of the invention.

We claim:

1. In a process for the cryogenic separation of air to recover at least a nitrogen-depleted crude argon product, wherein the process is carried out in a primary distillation system comprising at least a first distillation column, which separates a feed mixture comprising nitrogen, oxygen and argon into a nitrogen-enriched overhead and an oxygen-rich bottoms, and a side-arm column which rectifies an argon-containing feed stream fed from the primary distillation column to produce an essentially-oxygen-depleted argon overhead, characterized in that:

(a) a nitrogen-containing, argon-rich side stream is withdrawn from a location of the side-arm column which is above the location of entry of the argon-containing feed stream;

(b) the withdrawn, nitrogen-containing, argon-rich side stream of step (a) is fed to a nitrogen rejection column to remove the contained nitrogen, wherein the nitrogen rejection column contains at least a stripping section which is located below the location of the feed of the nitrogen-lean, argon-rich side stream, and wherein the stripping section of the nitrogen rejection column is provided with vapor boilup;

(c) the nitrogen-depleted, crude argon product is recovered and removed from the bottom of the nitrogen rejection column; and (d) at least a portion of upward flowing vapor in the nitrogen rejection column is removed from a location which is coincident to or above the location of the feed of the nitrogen-lean, argon-rich side stream to the nitrogen rejection column and the removed portion is returned to a suitable location of the side-arm column.

2. The process according to claim 1 wherein the withdrawn, nitrogen-containing, argon-rich side stream of step (a) is a liquid.

3. The process according to claim 2 wherein the withdrawn, nitrogen-containing, argon-rich side stream of step (a) is removed from a location of the side-arm column intermediate of the top of side arm column and where the argon-containing feed stream is fed to the side-arm column.

4. The process according to claim 2 wherein the side-arm column has a reboiler/condenser located at the top and wherein the oxygen-depleted argon overhead is removed from the side-arm column and partially condensed in the reboiler/condenser.

5. The process according to claim 4 wherein the partially condensed, oxygen-depleted argon is separated into a liquid phase portion and a vapor phase portion and wherein the vapor phase portion is vented as a nitrogen-containing purge.

6. The process according to claim 4 wherein the partially condensed, oxygen-depleted argon is separated into a liquid phase portion and a vapor phase portion and the vapor phase portion is partially condensed and phase separated into a second vapor phase portion and a second liquid phase portion and wherein the second vapor phase portion is vented as a nitrogen-containing purge.

7. The process according to claim 4 wherein the partially condensed, oxygen-depleted argon is fed to a first auxiliary column for rectification into a first auxiliary column overhead and a first auxiliary column bottoms liquid, wherein the first auxiliary column overhead is partially condensed and phase separated into a second vapor phase portion and a second liquid phase portion and wherein the second vapor phase portion is vented as a nitrogen-containing purge.

8. The process according to claim 4 wherein the partially condensed, oxygen-depleted argon is separated into a liquid phase portion and a vapor phase portion and the vapor phase portion is fed to a rectifying dephlegmator producing a dephlegmator overhead and wherein the dephlegmator overhead is vented as a nitrogen-containing purge.

9. The process according to claim 4 wherein the partially condensed, oxygen-depleted argon is separated into a liquid phase portion and a vapor phase portion and the vapor phase portion is fed to a first auxiliary column for rectification into a first auxiliary column overhead and a first auxiliary column bottoms liquid, wherein the first auxiliary column overhead is vented as a nitrogen-containing purge.

10. The process according to claim 4 wherein the nitrogen rejection column comprises a rectification section which is located above the location of the feed of the nitrogen-lean, argon-rich side stream; wherein vapor overhead exiting the top of the rectification section is removed from the nitrogen-rejection column and partially condensed, wherein the partially condensed overhead from the rectification section of the nitrogen rejection column is separated into a liquid phase portion and a vapor phase portion and wherein the vapor phase portion is vented as a nitrogen-containing purge.

11. The process according to claim 4 wherein the partially condensed, oxygen-depleted argon is separated into a liquid phase portion and a vapor phase portion and wherein the liquid phase portion is returned as reflux to the side-arm column.

12. The process according to claim 4 wherein the partially condensed, oxygen-depleted argon is separated into a liquid phase portion and a vapor phase portion and wherein a fraction of the liquid phase portion constitutes the stream withdrawn from the side-arm column of step (a).

13. The process according to claim 1 wherein said distillation system comprises a double distillation column consisting of a higher pressure column and a lower pressure column, and wherein the lower pressure column is the primary distillation column.

14. The process according to claim 3 wherein the intermediate location is between 1 and 10 stages below the top of the side-arm column.

15. The process of claim 1 vapor boil up for step (b) is provided by heat exchange between a suitable subcooled process stream and the nitrogen rejection column liquid bottoms.

16. The process of claim 1 wherein all of the upward flowing vapor in step (d) is returned to the side-arm column.

17. The process of claim 1 wherein the nitrogen-depleted, crude argon stream of step (c) is substantially nitrogen-free.

18. The process of claim 1 wherein the withdrawn, nitrogen-containing, argon-rich side stream of step (a) has an oxygen content which is less than 3% oxygen by molar content.

* * * * *